US008668116B2

(12) United States Patent
Ciavarella et al.

(10) Patent No.: US 8,668,116 B2
(45) Date of Patent: Mar. 11, 2014

(54) PUMP HAVING A FLEXIBLE MECHANISM FOR ENGAGEMENT WITH A DISPENSER

(75) Inventors: Nick E. Ciavarella, Seven Hills, OH (US); David D. Hayes, Wooster, OH (US); Joseph E. Crowe, Meadville, PA (US); Robert L. Quinlan, Jr., Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 602 days.

(21) Appl. No.: 12/557,978

(22) Filed: Sep. 11, 2009

(65) Prior Publication Data

US 2010/0059550 A1 Mar. 11, 2010

Related U.S. Application Data

(60) Provisional application No. 61/191,739, filed on Sep. 11, 2008.

(51) Int. Cl.
*B65D 88/54* (2006.01)
*B67D 7/06* (2010.01)

(52) U.S. Cl.
USPC ..... 222/153.13; 222/181.3; 222/321.6; 222/321.8; 239/602; 239/DIG. 12

(58) Field of Classification Search
USPC ..... 222/153.13, 153.14, 181.2, 181.3, 222/321.6–321.9, 325, 383.1, 509, 1; 239/602, DIG. 12; 403/329
See application file for complete search history.

(56) References Cited

U.S. PATENT DOCUMENTS

| | | | | | |
|---|---|---|---|---|---|
| 4,809,878 | A | * | 3/1989 | Rainey | 222/321.9 |
| 4,928,856 | A | * | 5/1990 | White | 222/174 |
| 4,979,648 | A | * | 12/1990 | Montgomery et al. | 222/153.14 |
| 5,165,577 | A | | 11/1992 | Ophardt | |
| 5,217,433 | A | * | 6/1993 | Bunin | 604/89 |

(Continued)

FOREIGN PATENT DOCUMENTS

| | | | |
|---|---|---|---|
| EP | 2 005 871 | A2 | 12/2008 |
| FR | 2315018 | A1 | 1/1977 |
| WO | 97/15223 | A1 | 5/1997 |

OTHER PUBLICATIONS

PCT International Preliminary Report on Patentability, Written Opinion of the International Searching Authority, In Related Application No. PCT/US2009/056648, Dated Mar. 15, 2011.

(Continued)

*Primary Examiner* — Kevin P Shaver
*Assistant Examiner* — Nicholas J Weiss
(74) *Attorney, Agent, or Firm* — Calfee, Halter & Griswold LLP

(57) ABSTRACT

A foam pump having a flexible member for engagement with a dispenser, the pump being part of a refill unit including a product reservoir. The flexible connecting member extends from an extreme end of the pump and is received by an actuating carriage that is movably connected to an actuating mechanism. The flexible connecting member permits insertion of the pump into a dispenser, and may act to dampen actuating forces to reduce foam shearing. The flexible connecting member may be provided in the form of a flared tip that is received through an oval opening in the product dispenser, and the pump may include a locking member to prevent unwanted actuation thereof during insertion of the refill unit into the dispenser.

13 Claims, 9 Drawing Sheets

(56) References Cited

U.S. PATENT DOCUMENTS

| | | | | | |
|---|---|---|---|---|---|
| D351,991 | S | * | 11/1994 | Bertolini et al. | D9/690 |
| 5,431,309 | A | | 7/1995 | Ophardt | |
| 5,826,755 | A | * | 10/1998 | Burd | 222/309 |
| 5,918,568 | A | | 7/1999 | Gjerloev | |
| 6,068,162 | A | * | 5/2000 | De Winter et al. | 222/181.3 |
| 6,543,649 | B1 | * | 4/2003 | Danielo et al. | 222/153.13 |
| 7,201,295 | B1 | * | 4/2007 | Sitzberger | 222/207 |
| 7,278,554 | B2 | | 10/2007 | Armstron | |
| 8,002,150 | B2 | * | 8/2011 | Ophardt et al. | 222/181.3 |
| 8,091,739 | B2 | * | 1/2012 | Ophardt et al. | 222/181.3 |
| 8,113,388 | B2 | * | 2/2012 | Ophardt et al. | 222/181.3 |
| 2009/0200338 | A1 | * | 8/2009 | Quinlan et al. | 222/190 |

OTHER PUBLICATIONS

PCT Search Report in Related Application No. PCT/US2009/056648, Dated Mar. 25, 2010.

EPO European Search Report and Opinion in related EP Application No. 13182161.3, dated Oct. 9, 2013.

* cited by examiner

PUMP HAVING A FLEXIBLE MECHANISM FOR ENGAGEMENT WITH A DISPENSER

This application claims priority from U.S. provisional patent application Ser. No. 61/191,739 filed on Sep. 11, 2008, which is incorporated herein by reference in its entirety.

FIELD OF THE INVENTION

The invention herein relates to a foam pump having a flexible mechanism for engagement with a foam product dispenser. More particularly, the invention relates to a flexible mechanism carried by a foam pump that allows the pump to be positioned within a dispenser and is received by an actuating carriage of the dispenser.

BACKGROUND OF THE INVENTION

It is well known in the art of foam pumps to provide a refill unit that is inserted into a foam product dispenser housing. The refill unit includes a product reservoir and a pump and is placed in the dispenser housing to create a product dispenser. Part of the dispenser housing, often the cover, pivots to expose an internal cavity defined by the housing and to allow the refill unit to be removed, when the product reservoir is empty, and replaced with a refill unit having a (preferably) full product reservoir. Thus, the dispenser housing can be refilled with product without requiring replacement of the entire dispenser. Typically, the dispenser includes an actuating mechanism that connects to, or is someway engaged, with the pump when the refill unit is received therein. The actuating mechanism of the dispenser may be a push bar, or may involve pivoting of the dispenser cover.

Notably, it is often difficult to insert the refill unit into the dispenser. Often times the engagement between the pump and the actuating mechanism of the dispenser housing is complicated and requires accurate alignment of the pump and refill unit to properly be received by the dispenser housing. This can result in difficulty and, at times, frustration on the part of the person installing the refill unit. In addition, if inserted improperly and with too much force, the engagement mechanism or the dispenser may become broken, or the refill unit may be actuated, resulting in dispensing of foam within the dispenser.

Another problem commonly associated with foam product dispensers results when a user presses too forcefully on the actuating mechanism. The high force applied to the actuating mechanism of the dispenser is transferred to the pump, resulting in shearing of the foam product, which causes poor quality foam to be dispensed that has a greater than desired liquid content.

Thus, the need exists for an improved mechanism on a foam pump for engaging the actuating mechanism of the dispenser, making installation of the pump easier, while also providing a dampening function to prevent foam shearing.

SUMMARY OF THE INVENTION

In light of the foregoing, it is a first aspect of the present invention to provide a refill unit for a product dispenser that is easy to install in the dispenser.

It is another aspect of the present invention to provide a refill unit, as above, that includes a connecting member extending from a foam pump, the connecting member having a flexible tip.

It is still another aspect of the present invention to provide a refill unit, as above, that includes a locking sleeve positioned on the connecting member to prevent unwanted actuating of the pump during shipping and installation.

In general, a refill unit according to the present invention includes a product reservoir and a pump in fluid communication with the product reservoir. The pump includes a flexible connecting member that is received by the actuating carriage of the dispenser.

In any embodiment of the invention the flexible connecting member may be provided in the form of a flared tip extending from the pump.

In any embodiment of the invention the flexible connecting member may be provided in the form of flexible extensions extending from the pump.

In any embodiment of the invention the pump may be a piston pump having a reciprocating piston.

In any embodiment of the invention a locking member may be provided that prevents unintended actuation of the pump.

In any embodiment of the invention the pump may include a pump housing having a generally oval shaped opening therein through which the piston extends.

In accordance with at least one aspect of the present invention, a product dispensing system includes a dispenser housing defining an internal cavity and having an actuating device pivotally connected thereto, an actuating carriage disposed within the internal cavity of the housing and movingly engaged with the actuating device, and a refill unit including a product reservoir and a pump, the pump being in fluid communication with the product reservoir. A flexible connecting member is secured to and extends from the pump, the flexible connecting member being received by the actuating carriage. Movement of the actuating carriage caused by movement of the actuating device is transferred to the pump by the flexible connecting member.

In any embodiment of the invention a lock ring may be provided within the internal cavity, the lock ring having a bottom surface and an opening positioned substantially concentrically in the bottom surface, wherein the lock ring receives the pump therein.

In any embodiment of the invention the bottom surface of the lock ring may be funnel shaped, sloping toward the opening.

In any embodiment of the invention the opening in the lock ring may be generally oval shaped, and the flexible connecting member may be generally conical in shape.

In any embodiment of the invention the oval opening in the lock ring may have a length and a width, the length being larger than the width, and the connecting member may have a diameter approximately equal to but slightly larger than the width of the oval opening.

In accordance with at least one aspect of the present invention, a method of connecting a pump to an actuating carriage of a product dispenser includes the steps of: providing an actuating carriage having a pair of concentric circular ribs defining a channel; providing a pump having a flexible connecting member extending therefrom; providing a lock ring within the product dispenser, the lock ring having an opening in a bottom surface, the bottom surface being sloped inward toward the opening; inserting the pump into the dispenser so that the flexible connecting member is forced to deform as it passes through the opening in the bottom surface; and allowing the flexible connecting member to return to its original shape and be received in the actuating carriage after passing through the opening in the lock ring.

BRIEF DESCRIPTION OF THE DRAWINGS

For a full understanding of the invention reference should be made to the following detailed description and the accompanying drawings, wherein:

FIG. 2 is a side elevational view of the foam product dispenser of

FIG. 1.

DETAILED DESCRIPTION OF THE ILLUSTRATIVE EMBODIMENTS

Figure 1:
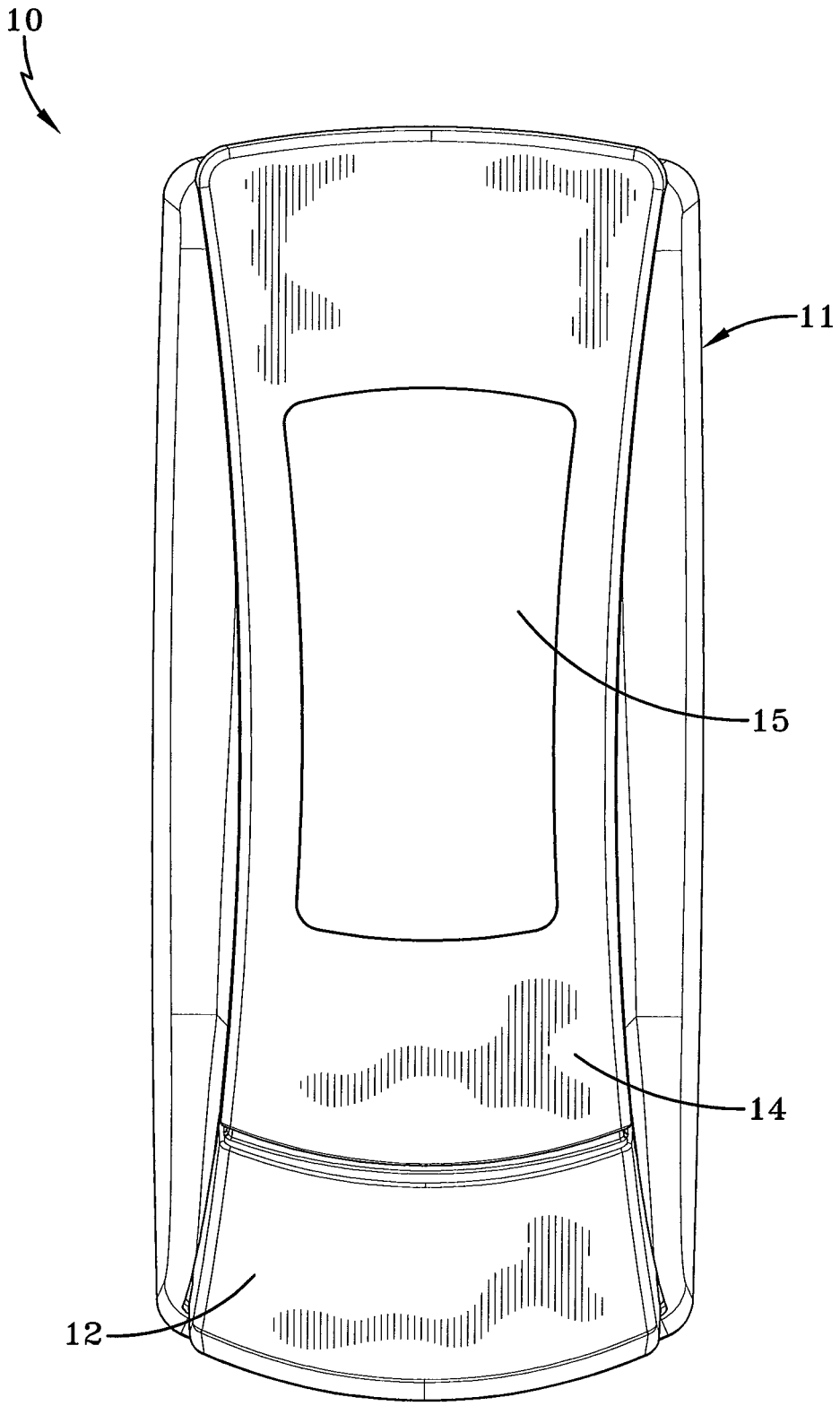
FIG. 1 is a front elevational view of a foam product dispenser according to the concepts of the present invention.
Figure 2:
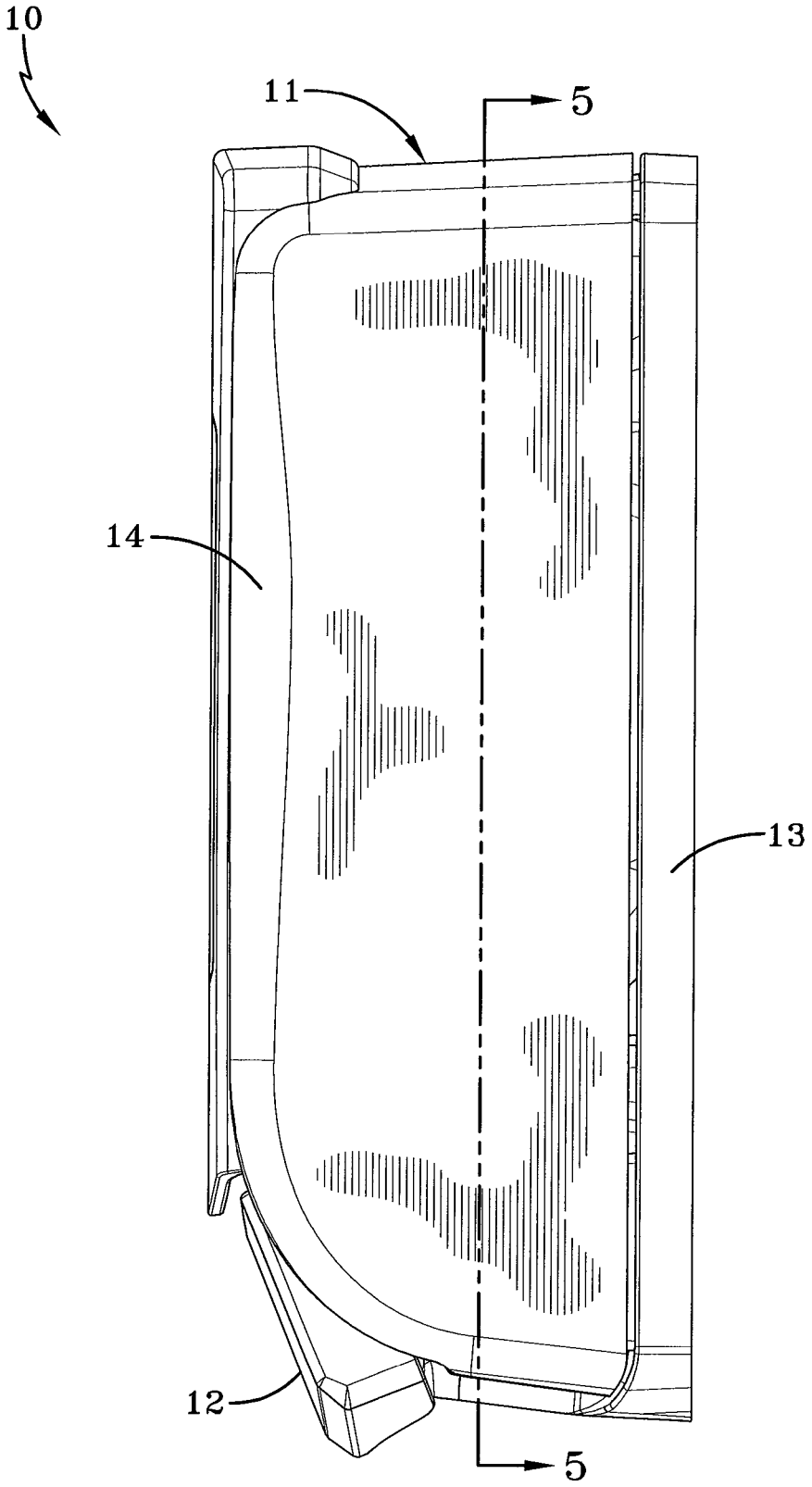

Referring now to FIGS. 1 and 2, a conventional product dispenser is shown and is generally indicated by the numeral 10. Dispenser 10 includes a housing 11 including a push bar 12, a back plate 13 (FIG. 2) and a pivoting cover 14. As is well known in the art, cover 14 pivots on back plate 13 to provide access to an internal cavity for refilling the dispenser. While a particular housing configuration for providing access to the internal cavity is contemplated and described herein, it should be appreciated that any such mechanism known to those skilled in the art may be employed. Push bar 12 is pressed by a user to actuate the foam pump within dispenser 10, and is biased to return to its non-actuated state after use. A window 15 may optionally be provided in cover 14 to allow visual inspection of the fluid level within the liquid reservoir in the dispenser 10.

Figure 3:
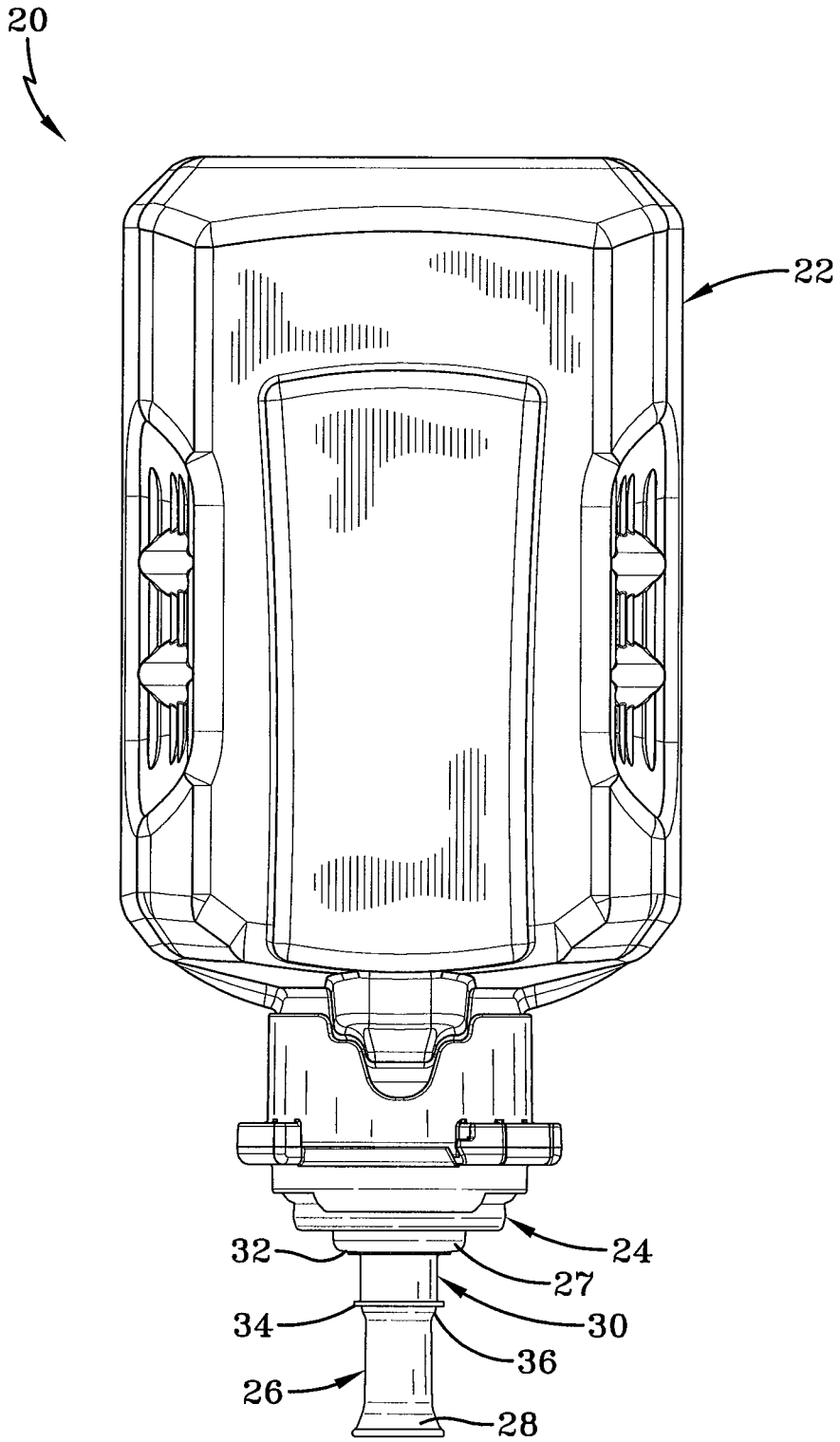
FIG. 3 is a front elevational view of the refill unit according to the concepts of the present invention showing the locking sleeve in a pre-loaded position.
Figure 4:
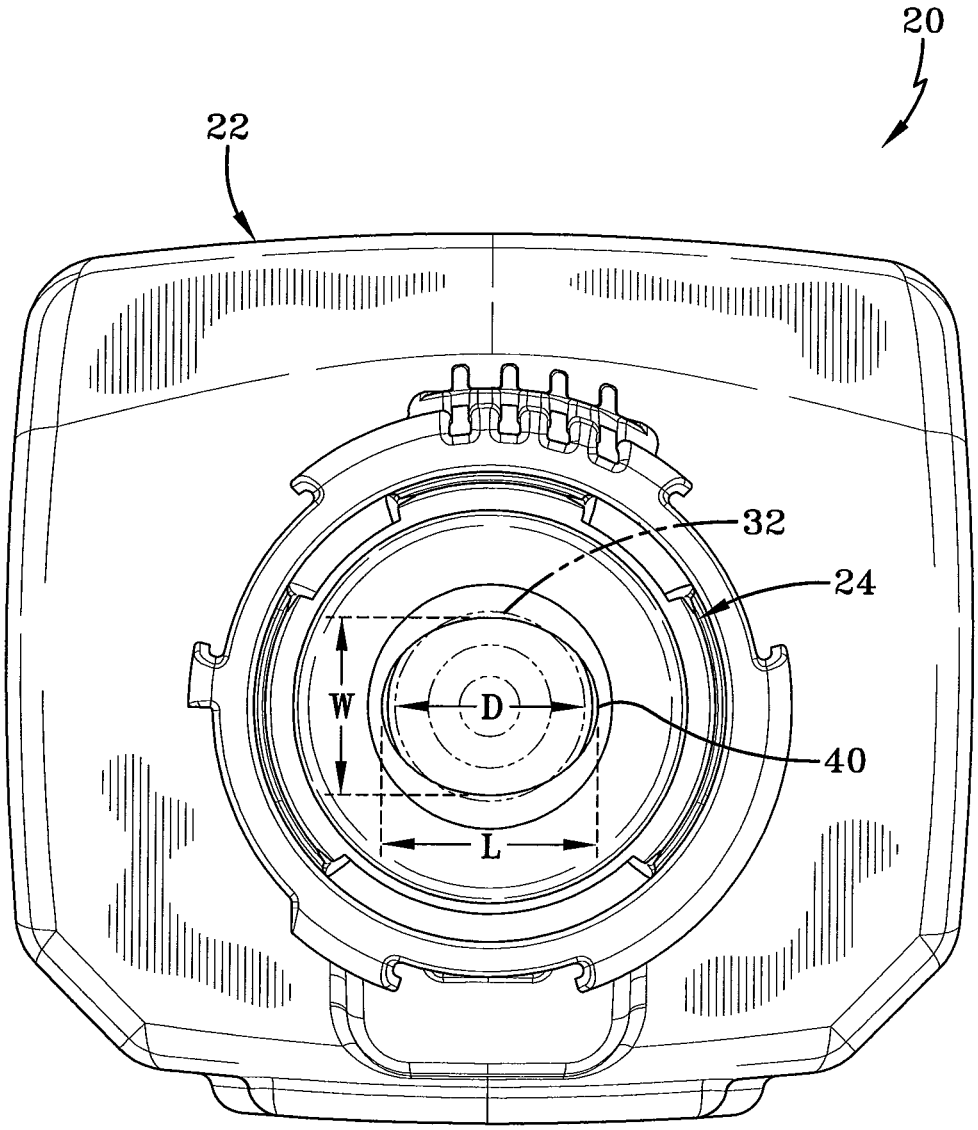
FIG. 4 is a top elevational view of the refill unit showing the oval-shaped opening in the pump.
Figure 4A:
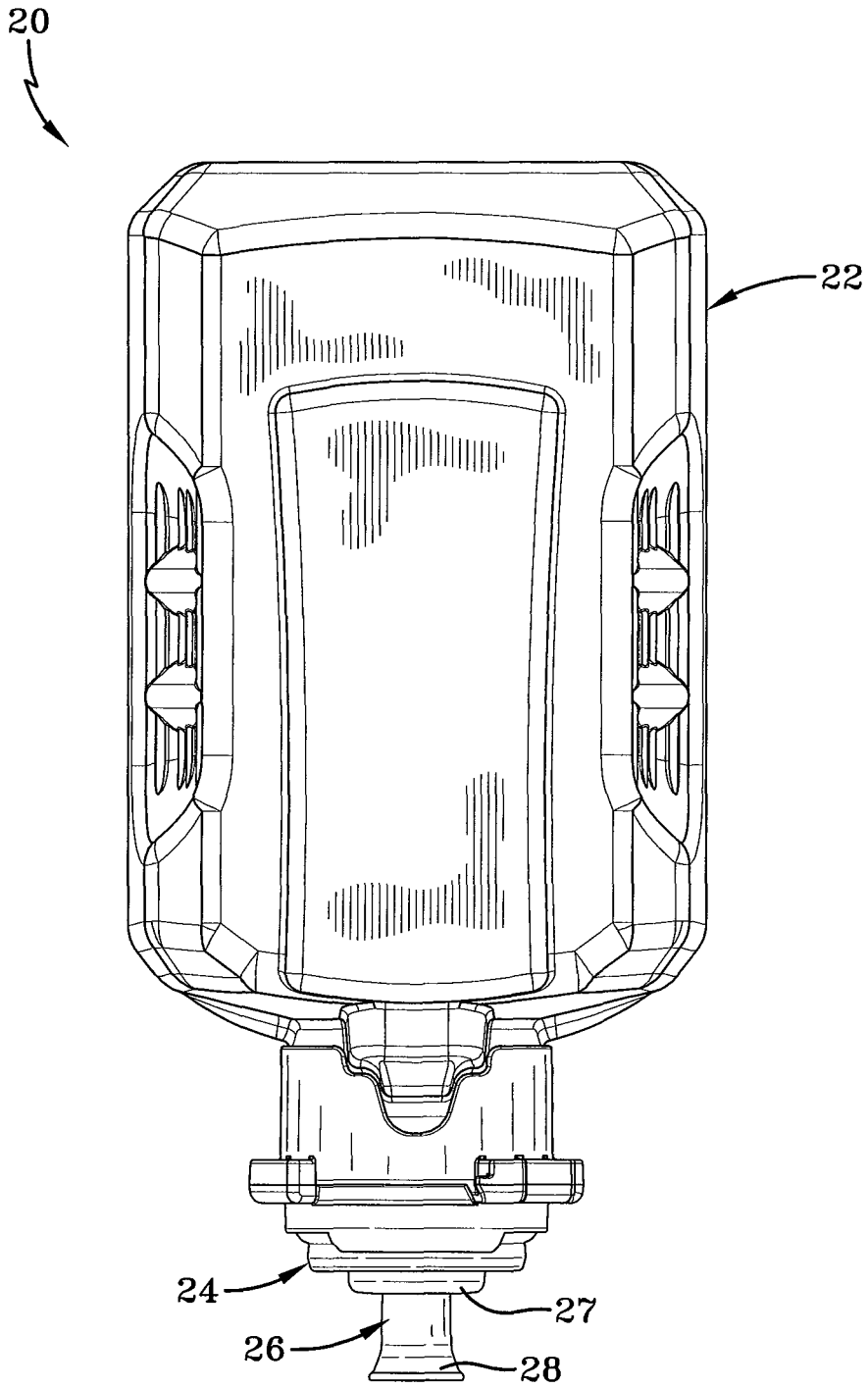
FIG. 4A is a front elevational view of the refill unit of FIG. 4 showing the pump in a loaded position.

FIGS. 3-4A depict a refill unit 20 that is to be inserted into housing 11 of dispenser 10. Refill unit 20 includes a product reservoir 22 that contains a product to be dispensed, such as, for example, liquid soap, hand sanitizer, gels, foams, or lotions. The contents of product reservoir 22 are in fluid communication with a piston pump 24 as is well known in the art. Various types of piston pumps are well known, and this invention is not limited to or by any particular piston pump structure. The structure and operation of piston pump 24 can take various forms not germane to the invention, and therefore will not be described in great detail. A piston pump functions by expelling a product from the pump when a piston is pressed into a pump housing, causing the volume of an internal cavity to decrease forcing the contents therein toward an outlet. The piston is biased to an unactuated position such that, when it is released the volume of the internal cavity increases and creates a vacuum to draw product from the product reservoir into the internal cavity. Although a piston pump 24 having a piston 26 and pump housing 27 is shown and described herein, it is contemplated that dispenser 10 may be adapted to accommodate other types of liquid or foam pumps that are known to those skilled in the art.

Pump 24 includes a flexible connecting member for engagement with an actuating mechanism within dispenser 10. The flexible connecting member extends from piston 26 in a direction opposite product reservoir 22. The flexible connecting member facilitates easy insertion of refill unit 20 and may, in some instances, act to dampen forces transmitted by the actuating mechanism and thereby reduce foam shearing in the case of a foam pump. The flexible connecting member may be provided in the form of a flexible tip 28 associated with an end of piston 26. Flexible tip 28 may be formed integrally with piston 26, or alternatively flexible tip 28 may extend from a sleeve that is secured to and around piston 26. Flexible tip 28 is adapted to transfer actuating forces from pushbar 12 to piston 26 and pump 24, as will be discussed in greater detail below.

Flexible tip 28 may be provided in any desired size and shape without deviating from the scope of the present invention, so long as flexible tip 28 is at least minimally flexible and resilient so that it can undergo at least some deformation and then return to its original state. In order to provide the required minimal flexibility, tip 28 may be made from an elastomeric material. In one or more embodiments, flexible tip 28 may have a hardness of between approximately 30-70 as measured on a Shore A durometer scale. In the embodiment of the invention depicted in FIGS. 3-6, flexible tip 28 is in the form of a flared tip having a generally conical shape extending from the end of the generally cylindrical piston 26.

In one or more embodiments, a locking sleeve 30 may be provided around piston 26. Locking sleeve 30 is generally annular in shape and includes axially opposing flanges 32 and 34 extending radially outward. A first flange 32 is positioned opposite flexible tip 28, and a second flange 34 is positioned on a side of locking sleeve 30 facing flexible tip 28. First flange 32 has an outer diameter that is larger than second flange 34. Locking sleeve 30 is restrained from axial movement on piston 26 in one direction by an outwardly extending annular rib 36 on the outer surface of piston 26. Thus, as shown in FIG. 3, locking sleeve 30 is positioned between annular rib 36 and an outer surface of pump housing 27.

Pump housing 27 includes an opening 40 (FIGS. 4A-6) through which a portion of piston 26 extends. Opening 40 is provided adjacent to first flange 32 of lock sleeve 30. As shown in FIG. 3, first flange 32 partially engages pump housing 27 around opening 40 to prevent movement of piston 26 relative to pump housing 27. In this way unintended actuation of pump 24 is prevented during storage, shipping, and insertion of refill unit 20 into housing 11. Opening 40 is provided in a shape that is different from the annular shape of first flange 32 such that contact is made only at several points. Opening 40 and first flange 32 are sized so that unintended and presumably low-force movement of piston 26 is prevented, but that the resistance of the engagement of first flange 32 can be overcome when refill unit 20 has been inserted into housing 11 and actuation of pump 24 is desired. Thus, once refill unit 20 has been properly installed within housing 11 of dispenser 10, a user must exert a higher than usual force on the first actuation of pump 24 through pushbar 12 in order to cause first flange 32 to move past and into opening 40, as depicted in FIG. 4A. Both first flange 32 and pump housing 27 are flexible and resilient to a sufficient extent to allow movement of locking sleeve 30 through opening 40 and into pump housing 27 when a great enough force is applied.

As shown in FIG. 4, opening 40 may be provided in the shape of an oval having a length L that is larger than its width W. The width of oval-shaped opening 40 is slightly smaller than the diameter D of first flange 32. However, the length of oval-shaped opening 40 is larger than the diameter D of first flange 32. Thus, first flange 32 of locking sleeve 30 engages pump housing 27 adjacent to oval-shaped opening 40 only at the sides adjacent the narrow width of the opening. The resistance provided by first flange 32 is easily overcome by a person actuating pump 24 for the first time. Second flange 34 is smaller in diameter than first flange 32, and is smaller than both W and L of oval opening 40, and therefore does not provide additional resistance against movement of piston 26.

Figure 5:
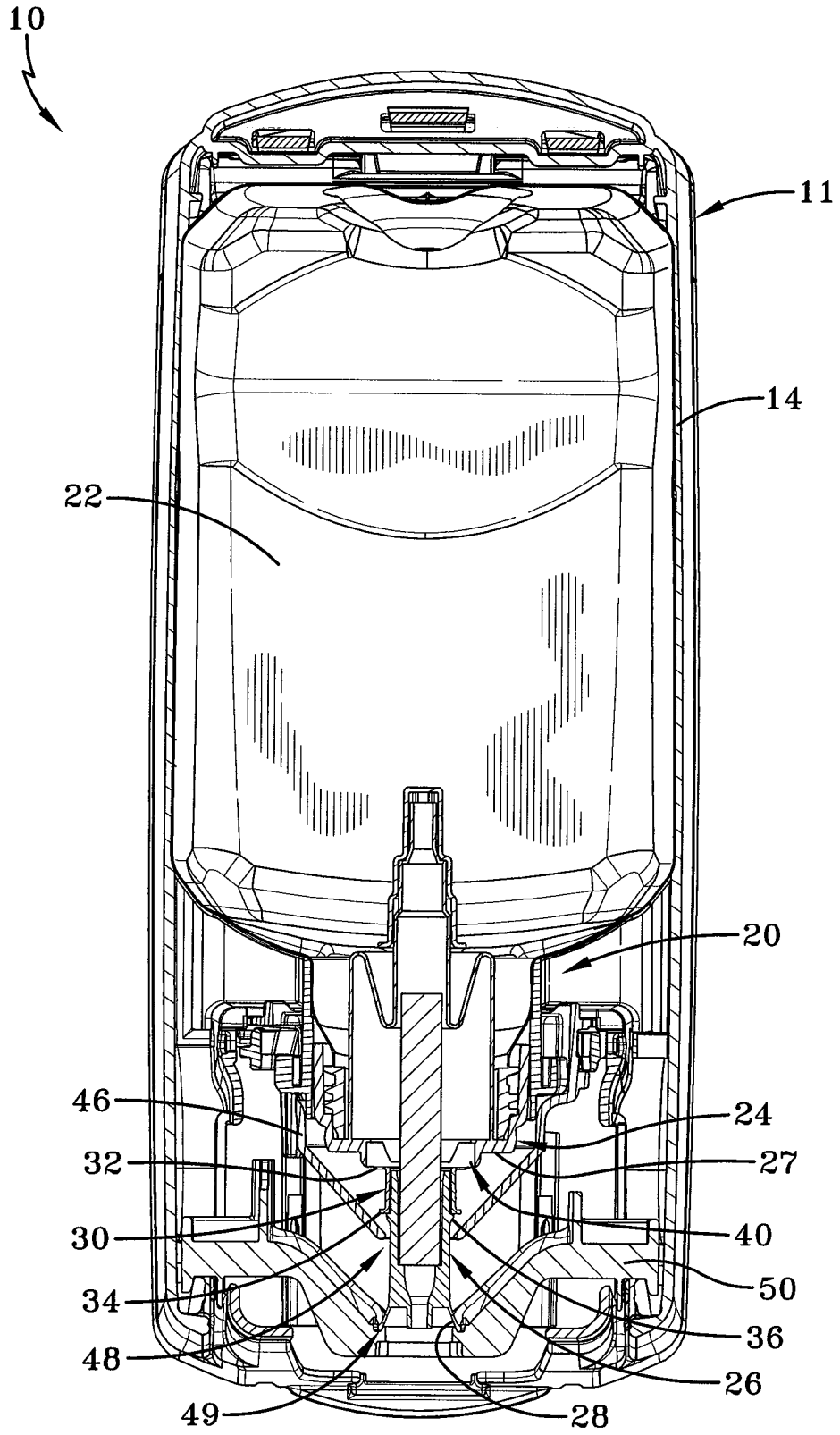
FIG. 5 is a section view of the dispenser taken generally across line 6-6 of FIG. 2 showing the actuating carriage and pump in an unactuated position.
Figure 6:
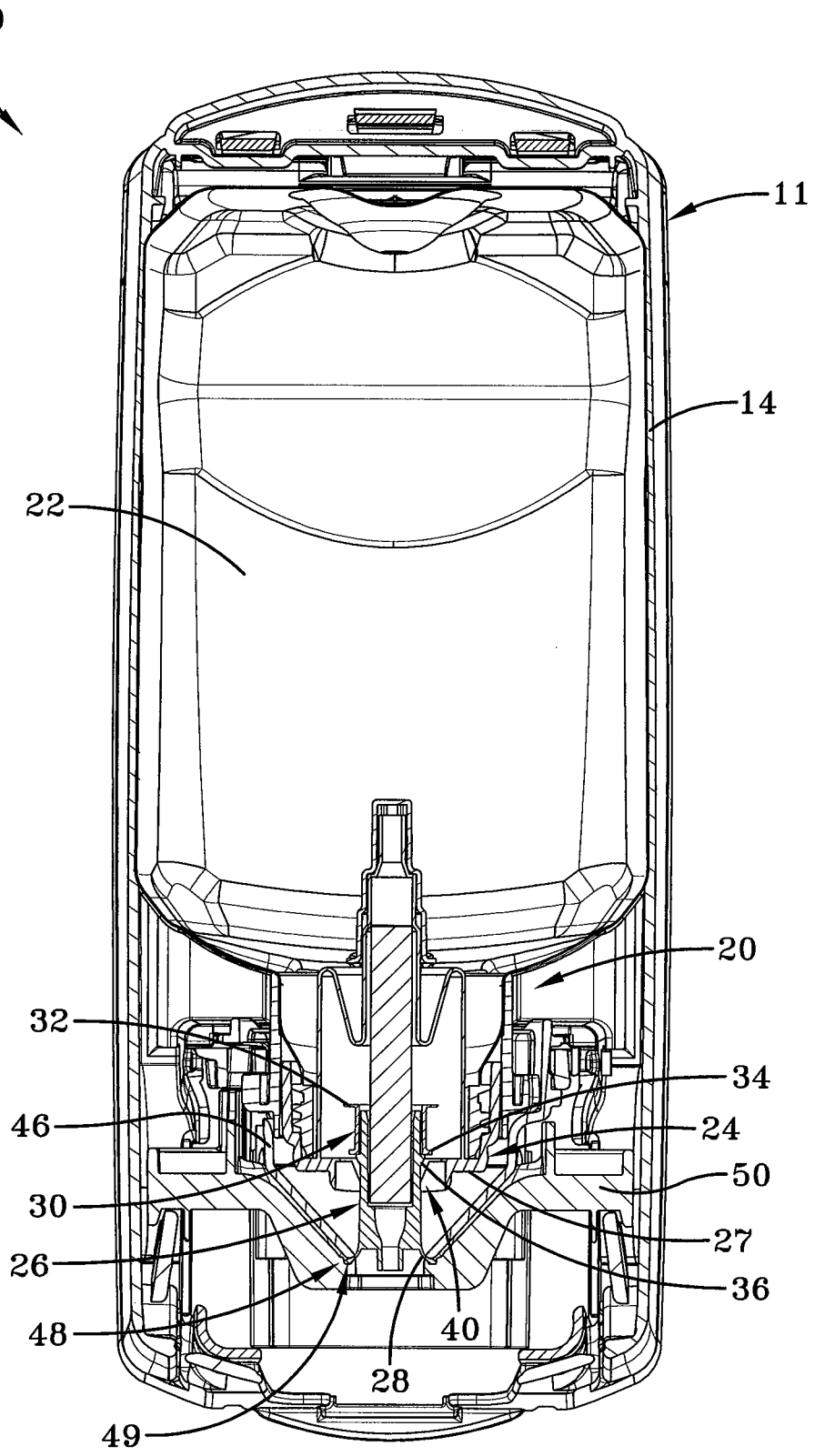
FIG. 6 is a section view as depicted in FIG. 6 showing the actuating carriage and pump in an actuated position.

With reference now to FIGS. 5 and 6, refill unit 20 is shown inserted into housing 11 of dispenser 10. A lock ring 46 is provided near the bottom end of the internal cavity within dispenser 10. Lock ring 46 is adapted to receive and secure pump 24 of refill unit 20 therein. Lock ring 46 includes an opening 48 positioned substantially at its center, with the bottom surface of lock ring 46 being funnel shaped and sloping towards opening 48. Opening 48 is generally oval-shaped and, like opening 40, has a length that is larger than its width. The width of opening 46 is slightly smaller than the largest diameter of generally conically shaped flexible tip 28. Thus, under pressure during insertion, flexible tip 28 deforms slightly to fit through opening 46. The deformation of flexible tip 28 as it passes through opening 46 is assisted by the funnel shape of the bottom surface of lock ring 46.

Once flexible tip 28 has passed through opening 48 in lock ring 46 it resumes its original generally conical shape and is received between a pair of circular ribs 49 on an actuating carriage 50. Actuating carriage 50 is movingly engaged with pushbar 12, or any other actuating mechanism known in the art, such that actuation causes movement of actuating carriage 50. Any system or mechanism known in the art may be employed to transfer motion from the actuator, in this case pushbar 12, to actuating carriage 50, such as, for example, a cam mechanism. As will be appreciated by those skilled in the art, the funnel shaped bottom surface of lock ring 46 and the flexible connecting member of pump 24, in this case flexible tip 28, allows for insertion of refill unit 20 in housing 11 without requiring precise alignment of the components.

FIG. 5 depicts the refill unit 20 positioned within housing 11 in a locked state, with locking sleeve 30 positioned between annular rib 36 and pump housing 27. When actuating carriage 50 is caused to move upward upon the first actuation of pump 24, first flange 32 of locking sleeve 30 is forced through oval-shaped opening 40 in pump housing 27, thereby allowing movement of piston 26 relative to piston housing 27. FIG. 6 shows locking sleeve 30 in a post-actuation position within pump housing 27. After the first actuation of pump 24, locking sleeve 30 no longer inhibits movement of piston 26 because first flange 32 is no longer engaged with pump housing 27 to prevent actuating movement of piston 26. It should be appreciated that other locking mechanisms may be employed to prevent unintended and unwanted actuation of pump 24 during storage, transport and installation. For example, a weak thermoplastic weld may be provided between piston 26 and piston housing 27 during manufacturing of pump 24, the weak weld being overcome by the initial actuation of pump 24 in a manner similar to what is described above.

Figure 8:
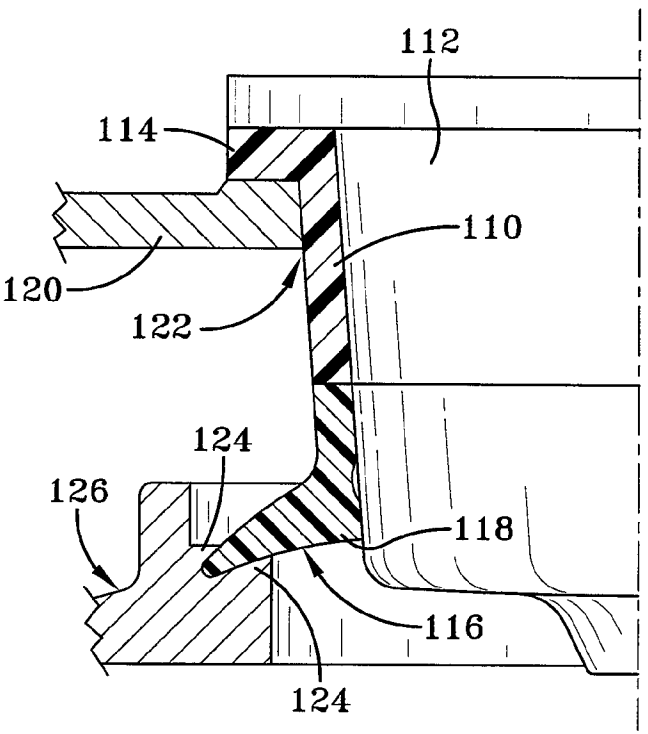
FIG. 8 is a section view of the embodiment of FIG. 8 in a fully inserted state.
Figure 7:
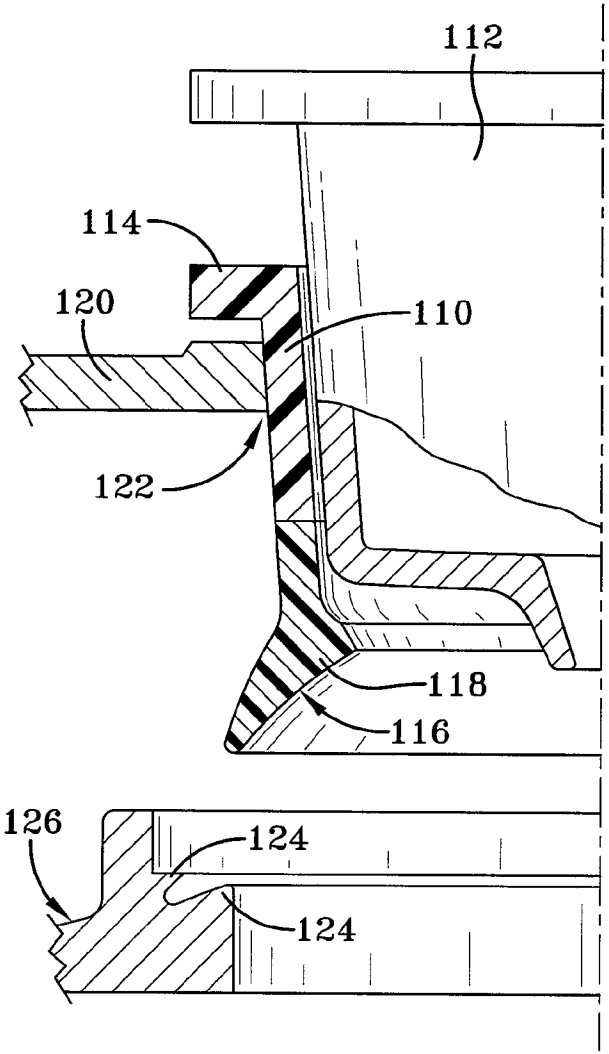
FIG. 7 is a section view of a second embodiment of the foam pump connecting member in a partially inserted state.

With reference now to FIGS. 7 and 8, a second embodiment of the flexible connecting member is shown. The second embodiment depicted in FIGS. 7 and 8 may be substituted for the flexible connecting member shown in FIGS. 3-6, as will be apparent to those skilled in the art. In the second embodiment, a dispenser coupler 110 is positioned concentrically around a pump 112. The dispenser coupler 110 includes an outwardly extending flange 114 at its upper end. A plurality of flexible extensions 116, also referred to as flexible feet 116, extend from the bottom end of dispenser coupler 110 and are spaced around the lower circular edge of the coupler. Flexible feet 116 include inwardly projecting portions 118 that extend under pump 112 and have a radiused surface. Pump 112 is slidably positioned within dispenser coupler 110, and may include stops (not shown) to limited the sliding movement thereof. A lock ring 120 is provided in a dispenser, as in the first embodiment, and is adapted to receive dispenser coupler 110 therein. In this embodiment, unlike in the first embodiment, lock ring 120 does not include a funnel shaped lower end, but instead has a substantially planar lower surface. Lock ring 120 does, however, include an opening 122 to receive dispenser coupler 110. When the pump 112 is inserted into a dispenser, the dispenser coupler 110 is received in opening 122 of lock ring 120.

When flange 114 engages lock ring 120 during insertion of a refill unit, the dispenser coupler 110 is restricted from further movement through the opening. Pump 112 then slides within dispenser coupler 110 to engage flexible feet 116. Due to the radiused surface on flexible feet 116, they are forced outwardly when engaged by pump 112. When folded out, flexible feet 116 are received in a pair of circular ribs 124 on an actuating carriage 126, thereby connecting the carriage to the pump to allow for actuation of the pump. FIG. 7 shows pump 112 in a partially inserted state, prior to engagement of flexible feet 116. FIG. 8 depicts pump 112 in a fully inserted state, with flexible feet 116 received in circular ribs 124.

Figure 9:
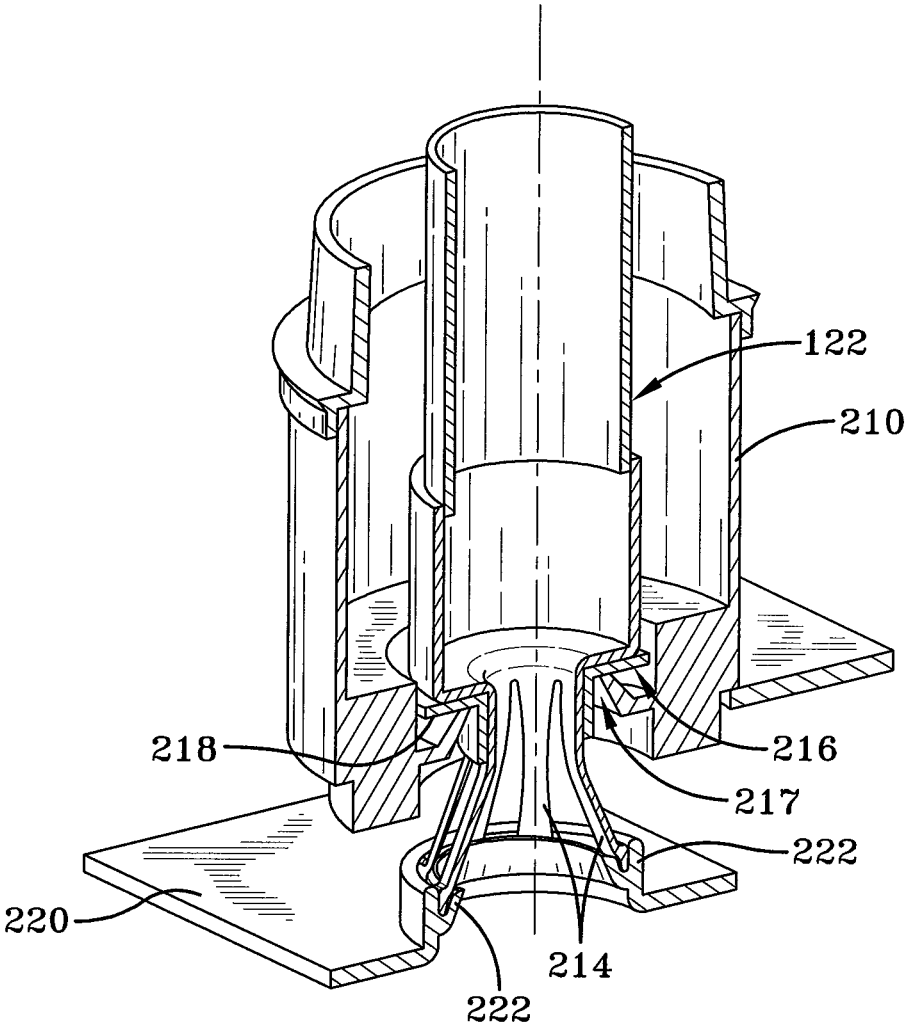
FIG. 9 is a perspective view of a third embodiment of the foam pump connecting member.

With reference now to FIG. 9, a third embodiment of the flexible mechanism for connecting a foam pump into the dispenser is shown. Similar to the second embodiment discussed above, the third embodiment of the flexible connecting member may be substituted in the refill unit 20 shown in FIGS. 3-6. In the third embodiment, a dispenser coupler 210, that is generally cylindrical in shape, is positioned around the lower end of a pump 212. A plurality of elongated flexible extensions 214, also referred to as flexible fingers 214, are connected to a lower end of pump 212 and project through an opening in the lower end of dispenser coupler 210. Flexible fingers 214 naturally arch outward away from each other as they extend away from pump 212.

A cylindrical collar 216 is provided around flexible fingers 214, such that when it is positioned at an extreme end of fingers 214, they are restricted from arching outward. Conversely, when cylindrical collar 216 is positioned adjacent to dispenser coupler 210, flexible fingers 214 are permitted to arch as molded. Prior to insertion into a dispenser, collar 216 is positioned at the extreme end of flexible fingers 214 to restrict their outward arching and to facilitate insertion. As flexible fingers 214 and collar 216 are inserted into a housing, the fingers and collar pass through an opening in the bottom of a lock ring at the bottom of the dispenser as in the second embodiment discussed above. An outwardly extending flange 218 of collar 216 catches on the lock ring around the opening so that the cylindrical body of collar 216 remains in the opening of the lock collar. The flexible fingers 214 then slide through the lock collar 216 and extend through the opening while returning to their naturally outward arching positions. As fingers 214 return to their natural shape, they are received between two circular ribs 222 on an actuating carriage 220.

As will be appreciated by those skilled in the art, each of the above embodiments includes flexible connecting members that allow a pump to be positioned within a dispenser housing by virtue, at least in part, of their ability to deform. The flexible members provide a connection between the pump and an actuating carriage to transfer an input force to the pump, thereby generating foam. The deformable and resilient nature of the flexible members provide a dampening function if an actuating member, such as push bar 12, is actuated with too much force. As will also be appreciated, each embodiment provides a reliable structure for facilitating proper mounting of a refill unit in a dispenser housing.

It is thus evident that a product dispenser constructed as described herein accomplishes the objects of the present invention and otherwise substantially improves the art. In accordance with the Patent Statutes, only the best mode and preferred embodiment have been presented and described in detail, and the invention should not be limited by that description. For an appreciation of the true scope and breadth of the invention, reference should be made to the following claims.

The invention claimed is:

1. A refill unit for use in a product dispensing system including a dispenser housing having an actuating device that engages an actuating carriage, the refill unit comprising:

a product reservoir; and a pump in fluid communication with said product reservoir, said pump including a flexible connecting member that is received by and engaged by the actuating carriage;

wherein the flexible connecting member is a flared tip and comprises an elastomeric material, the flared tip is substantially conical in shape and the substantially conical portion of the flared tip is continuous;

wherein the tip flares outward in the downward direction; and the flared tip deflects from its original conical shape to conform to an oval shape that allows the flared tip to pass through a funnel shaped lock ring having an oval-shaped opening and once past the oval-shaped opening, the flared tip returns to its original conical shape; and the flared tip is configured to engage the actuator carriage having an opening therethrough without expanding from its original substantially conical shape and the flared tip remains above the actuator carriage.

2. The refill unit of claim 1, wherein the elastomeric material has a Shore A hardness of between about 30 and 70 durometers.

3. The refill unit of claim 1, wherein said pump is a piston pump having a reciprocating piston.

4. The refill unit of claim 3, wherein said flexible connecting member extends from an end of said piston.

5. The refill unit of claim 3, further comprising a locking member that prevents unintended actuation of said pump.

6. The refill unit of claim 5, wherein said locking member is a sleeve positioned around said piston, said sleeve including a first annular flange facing said pump and a second annular flange opposite said first annular flange.

7. The refill unit of claim 6, wherein said first flange engages said pump and said second flange engages an annular rib extending outwardly from said piston, said flanges thereby preventing movement of said piston relative to said product reservoir.

8. The refill unit of claim 7, wherein said pump includes a pump housing, and wherein said piston extends through an opening in said pump housing, said opening being substantially oval shaped.

9. The refill unit of claim 8, wherein said oval shaped opening has a length and a width, said length being larger than said width, and wherein said first flange has a diameter approximately equal to but slightly larger than said width of said substantially oval shaped opening.

10. A product dispensing system comprising:

a dispenser housing defining an internal cavity and having an actuating device pivotally connected thereto;

a stationary funnel-shaped lock ring located in the internal cavity, the funnel-shaped lock ring having a generally oval-shaped opening having a length and a width, said length being larger than said width;

an actuating carriage disposed within said internal cavity of said housing and movingly engaged with said actuating device;

the actuating carriage located below the stationary funnel-shaped lock ring;

a refill unit including a product reservoir and a pump, said pump being in fluid communication with said product reservoir; and a flexible connecting member secured to and extending from said pump, wherein the flexible connecting member is a flared tip that flares outward in the downward direction and comprises an elastomeric material, the flared tip is substantially conical in shape, and the substantially conical portion of the flared tip is continuous, and the said flexible connecting member being received by said actuating carriage, wherein movement of said actuating carriage caused by movement of said actuating device is transferred to said pump by said flexible connecting member; and the flared tip deflects to conform to an oval shape that allows the flared tip to pass through the generally oval-shaped opening of the stationary funnel-shaped lock ring and once past the oval-shaped opening, the flared tip returns to its original substantially conical shape; and the flared tip is configured to engage the actuator carriage having an opening therethrough and the flared tip remains above the actuator carriage.

11. The product dispensing system of claim 10, wherein the elastomeric material in said flexible connecting member has a Shore A hardness of between about 30 and 70 durometers.

12. The product dispensing system of claim 10, wherein said flexible connecting member has a diameter approximately equal to but slightly larger than said width of said oval opening.

13. A method of connecting a pump to an actuating carriage of a product dispenser comprising:

providing an actuating carriage having a pair of concentric circular ribs defining a channel;

providing a pump having a flexible connecting member extending therefrom wherein the flexible connecting member is a flared tip that flares outward in the downward direction and comprises an elastomeric material, the flared tip is substantially conical in shape, and the substantially conical portion of the flared tip is continuous;

the flared tip is configured to engage an actuator carriage having an opening therethrough during operation and the flared tip remains above the actuator carriage;

providing a lock ring within the product dispenser, the stationary lock ring having an oval-opening in a bottom surface, the bottom surface being sloped inward toward the oval-opening;

wherein the lock ring is located above the actuator carriage;

inserting the pump into the dispenser so that said flexible connecting member is forced to deform as it passes through said oval-opening in said bottom surface; and allowing the flexible connecting member to return to its original shape and be engaged by the actuating carriage after passing through the opening in the lock ring.

* * * * *